US010244846B2

(12) United States Patent
Kim et al.

(10) Patent No.: US 10,244,846 B2
(45) Date of Patent: Apr. 2, 2019

(54) COSMETIC IMPREGNATED FOAM MANUFACTURING METHOD

(71) Applicant: CIT Co., Ltd., Chungcheongnam-do (KR)

(72) Inventors: Jae Jin Kim, Gyeonggi-do (KR); Jong Taek Jeon, Gyeonggi-do (KR); Young Il Lee, Chungcheongnam-do (KR); Kyeong Bin Kwon, Chungcheongnam-do (KR)

(73) Assignee: CIT CO., LTD., Chungcheongnam-do (KR)

( * ) Notice: Subject to any disclaimer, the term of this patent is extended or adjusted under 35 U.S.C. 154(b) by 484 days.

(21) Appl. No.: 14/996,268

(22) Filed: Jan. 15, 2016

(65) Prior Publication Data

US 2016/0207644 A1 Jul. 21, 2016

(30) Foreign Application Priority Data

Jan. 15, 2015 (KR) ..... 10 2015 0007178

(51) Int. Cl.
*B65B 3/04* (2006.01)
*A45D 40/24* (2006.01)
(Continued)

(52) U.S. Cl.
CPC ..... *A45D 40/24* (2013.01); *A45D 34/04* (2013.01); *B65B 43/62* (2013.01); *B65B 61/20* (2013.01);
(Continued)

(58) Field of Classification Search
CPC ..... A45D 40/24; A45D 2040/0012; B65B 37/02; B65B 3/00; B65B 3/04
(Continued)

(56) References Cited

U.S. PATENT DOCUMENTS 3,864,181 A * 2/1975 Wolinski ..... C08J 9/04 156/204
5,059,414 A * 10/1991 Dallal ..... A61K 8/03 424/401
(Continued)

FOREIGN PATENT DOCUMENTS

KR 20060024612 3/2006
KR 10 1490682 * 2/2015 ..... A45D 34/06
KR 10 1385652 * 5/2017 ..... A45D 34/04

OTHER PUBLICATIONS

Translation of KR 10 1490682.*
Translation of KR 10 1385652.*

*Primary Examiner* — Gloria R Weeks
(74) *Attorney, Agent, or Firm* — Calfee, Halter & Griswold LLP

(57) ABSTRACT

A cosmetic impregnated foam manufacturing apparatus of the present disclosure includes: a fixing holder for fixing a container; a two or more multi nozzles for filling the container with liquid-state make-ups having different colors and viscosities; a pressing member pressing the impregnated foam to the container filled with the liquid-state make-ups; and a fabric placed on the impregnated foam. Accordingly, various colors and patterns are achieved by impregnating two or more liquid-state make-ups having different colors by the two or more multi nozzles and the fixing holder that is rotated and horizontally moved.

5 Claims, 3 Drawing Sheets

(51) Int. Cl.

| | |
|---|---|
| ***B65B 43/62*** | (2006.01) |
| ***B65B 61/20*** | (2006.01) |
| ***A45D 34/04*** | (2006.01) |
| *A45D 40/00* | (2006.01) |
| *B65B 39/00* | (2006.01) |

(52) U.S. Cl.
CPC ..... *A45D 2040/0012* (2013.01); *A45D 2200/1009* (2013.01); *A45D 2200/1018* (2013.01); *A45D 2200/1036* (2013.01); *B65B 3/04* (2013.01); *B65B 2039/009* (2013.01); *B65B 2220/14* (2013.01)

(58) Field of Classification Search
USPC ..... 53/474, 475
See application file for complete search history.

(56) References Cited

U.S. PATENT DOCUMENTS 5,137,040 A * 8/1992 Iosilevich ..... A45D 33/00 132/218
7,427,412 B1 * 9/2008 Painter ..... A61K 8/0208 424/443
7,700,076 B2 * 4/2010 Tamarkin ..... A61K 8/046 424/47
7,850,882 B2 * 12/2010 Smith ..... A61L 15/26 264/45.1
8,087,417 B2 * 1/2012 Dobler ..... A45D 40/0087 132/320
8,257,718 B2 * 9/2012 Mammone ..... A45D 33/00 424/401
8,362,089 B2 * 1/2013 Hashimoto ..... A61K 8/0208 514/778
9,113,692 B2 * 8/2015 Khan ..... A45D 40/00
9,215,920 B2 * 12/2015 Dobler ..... A45D 40/0087
9,585,456 B2 * 3/2017 Choi ..... A45D 34/04
9,713,580 B2 * 7/2017 Sunkel ..... A61K 8/0216
9,744,117 B2 * 8/2017 Kang ..... A61K 8/046
9,867,447 B1 * 1/2018 Kim ..... A45D 40/24
2007/0098770 A1 * 5/2007 Shikinami ..... A61K 8/0208 424/449
2015/0079862 A1 * 3/2015 Jeong ..... A45D 34/00 442/1
2017/0079408 A1 * 3/2017 Lee ..... A61Q 17/04
2017/0119633 A1 * 5/2017 Park ..... A45D 33/006
2018/0015005 A1 * 1/2018 Cho ..... A61Q 1/02
2018/0070700 A1 * 3/2018 Choi ..... A45D 34/04
2018/0207066 A1 * 7/2018 Lechanoine ..... A61Q 1/00
2018/0235344 A1 * 8/2018 Yamanaka ..... A45D 34/04

* cited by examiner

| Filling ratio (White: Beige) | 50:50 | |
|---|---|---|
| Impregnated foam |  |  |
| Viscosity | Difference less than 1000 cps | Difference of 3000 cps or more |

COSMETIC IMPREGNATED FOAM MANUFACTURING METHOD

CROSS-REFERENCE TO RELATED APPLICATIONS

This application is based on and claims priority from Korean Patent Application No. 10-2015-0007178, filed on Jan. 15, 2015, with the Korean Intellectual Property Office, the disclosure of which is incorporated herein in its entirety by reference.

TECHNICAL FIELD

The present disclosure relates to a cosmetic impregnated foam manufacturing apparatus and a method thereof, and more particularly, a cosmetic impregnated foam manufacturing apparatus for impregnating two or more liquid-state make-ups with different colors, and a method of manufacturing the cosmetic impregnated foam.

BACKGROUND

In the past, cosmetics were generally used indoors, but recently, with a change in life style such as popularization of leisure, cosmetics are increasingly used outdoors. Accordingly, there is an increasing demand for a cosmetic that can be easily carried and used.

Accordingly, a cosmetic that can be simply carried and used by impregnating a liquid-state make-up in an impregnated foam has been developed.

A compact that keeps an impregnated foam impregnated with a liquid-state make-up to make a user feel cool in summer has been sold. Users press the impregnated foam with a liquid-state make-up by a puff to put the liquid-state make-up on the puff and scrub the puff on the face.

The impregnated foam is a foamed product, that is, a sponge or a urethane foam.

A method of impregnating a liquid-state make-up on a cosmetic impregnated foam is described with reference to FIG. 1.

As illustrated in FIG. 1, a container 20 fixed to a fixing holder 10 is first filled with a liquid-state make-up through one nozzle 30.

Next, an impregnated foam 40 is put on the liquid-state make-up in the container 20.

Then, the liquid-state make-up is impregnated into the impregnated foam by pressing the impregnated foam 40 with a pressing member 50.

However, there is a problem in the method of FIG. 1 that only one color can be expressed.

That is, when two or more liquid-state make-ups with different colors are impregnated, the liquid-state make-ups with different colors are mixed with each other, so the commercial value decreases.

Accordingly, it has been required to develop an apparatus for a cosmetic impregnated foam having a high commercial value by impregnating two or more liquid-state make-ups with different colors, and a method of manufacturing the cosmetic impregnated foam.

PRIOR ART DOCUMENT

[Patent Document 1] Korean Patent Application Publication No. 2006-0024612 (Mar. 17, 2006)

SUMMARY

The present disclosure has been made in an effort to provide an apparatus and a method of manufacturing a cosmetic impregnated foam that can express various colors and patterns by impregnating two or more liquid-state make-ups having different colors.

According to the exemplary embodiments of the present disclosure, a cosmetic impregnated foam manufacturing apparatus of the present disclosure includes: a fixing holder for fixing a container; a two or more multi nozzles for filling the container with liquid-state make-ups having different colors and viscosities; a pressing member pressing the impregnated foam to the container filled with the liquid-state make-ups; and a fabric placed on the impregnated foam.

Further, the fixing holder is rotated and horizontally moved.

Further, the two or more liquid-state make-ups have a viscosity difference less than 3000 cps.

Further, the pressing member is moved to at a transfer speed until the impregnated foam and the liquid-state make-up in the container are brought in contact with each other, when the impregnated foam and the liquid-state make-up in the container are brought in contact with each other, the pressing member slowly presses the impregnated foam at an impregnation speed lower than the transfer speed, and when the impregnated foam is impregnated with the liquid-state make-up in the container and the impregnating is finished, the pressing member is moved upward at the transfer speed and the fabric is removed.

Further, air pressure of 1 to 2 $kg/m^2$ is applied to the pressing member moving at the transfer speed, air pressure of 0.1 to 0.2 $kg/m^2$ is applied to the pressing member moving at the impregnation speed, and the pressing member stops for 2 to 4 seconds after pressing the impregnated foam when the impregnated foam is impregnated with a liquid-state make-up.

A method of manufacturing a cosmetic impregnated foam of the present disclosure includes:

I) forming a pattern and filling a container with two or more liquid-state make-ups having different colors and viscosities;

II) putting an impregnated foam with a fabric thereon onto the liquid-state make-ups in the container and performing impregnation; and III) separating the impregnated foam and the fabric.

Further, in the step I), the container is rotated and horizontally moved when two or more liquid-state make-ups having different color and viscosities are discharged.

Further, the two or more liquid-state make-ups have a viscosity difference less than 3000 cps.

Further, in the step II), the impregnated foam is moved at a transfer speed until the impregnated foam and the liquid-state make-ups in the container are brought in contact with each other, and when the impregnated foam and the liquid-state make-ups are brought in contact with each other, the impregnated foam is impregnated with the liquid-state make-ups at an impregnation speed smaller than the transfer speed.

Further, in the step II), the impregnated form is stopped for 2 to 4 seconds, after being impregnated with the liquid-state make-ups.

According to the cosmetic impregnated foam manufacturing apparatus and a method thereof, various colors and patterns are achieved by impregnating two or more liquid-state make-ups having different colors by the two or more multi nozzles 300 and the fixing holder that is rotated and horizontally moved.

Further, by making the viscosity different of liquid-state make-ups having different colors within 3000 cps, the liquid-state make-ups having different colors are prevented from invading each other during impregnation.

Further, a pattern is prevented from being crushed by the fabric 600 on the impregnated foam during pressing.

As a result, the commercial value is increased by the impregnated foam with various colors and patterns.

DETAILED DESCRIPTION

Hereinafter, exemplary embodiments of the present disclosure will be described in detail with reference to the accompanying drawings.

Figure 1:
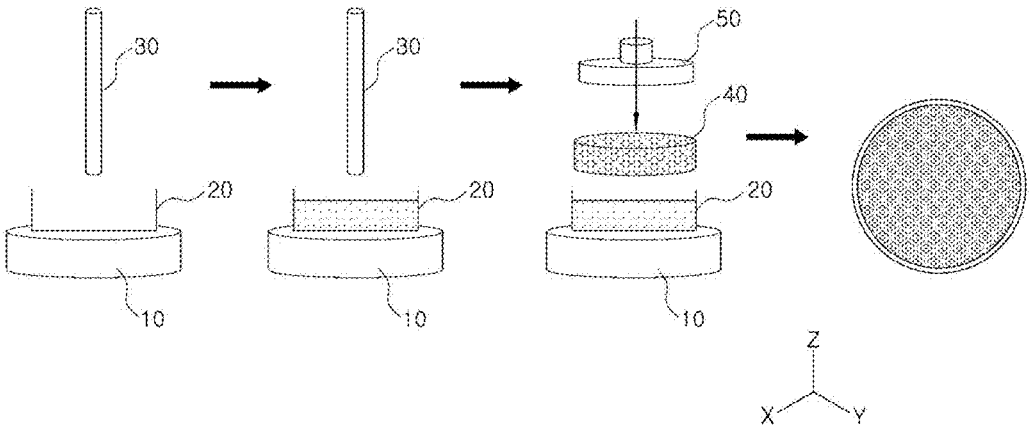
FIG. 1 is a diagram illustrating a method of manufacturing an impregnated foam in the related art.
Figure 2:
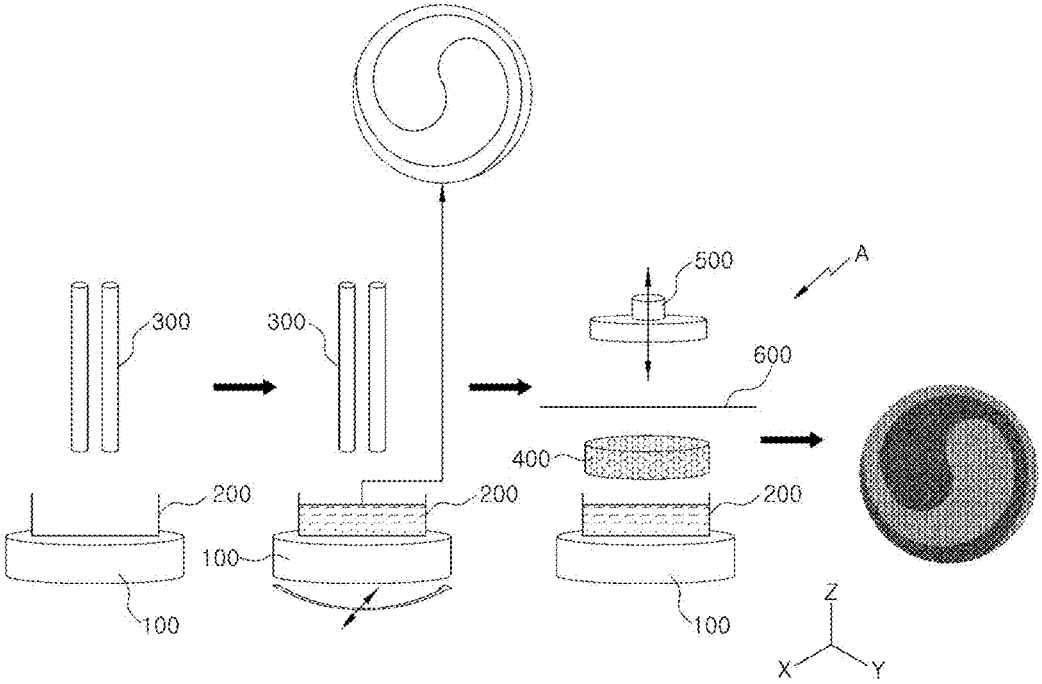
FIG. 2 is a diagram illustrating a cosmetic impregnated foam manufacturing apparatus according to the present disclosure.
Figure 3:
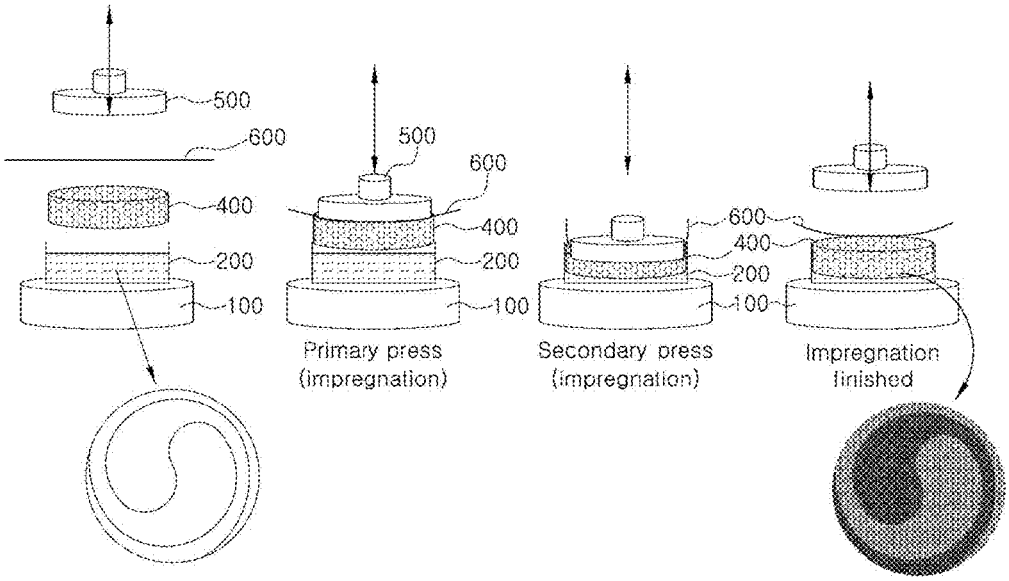
FIG. 3 is a diagram illustrating a pressing member of FIG. 2.
Figure 4:
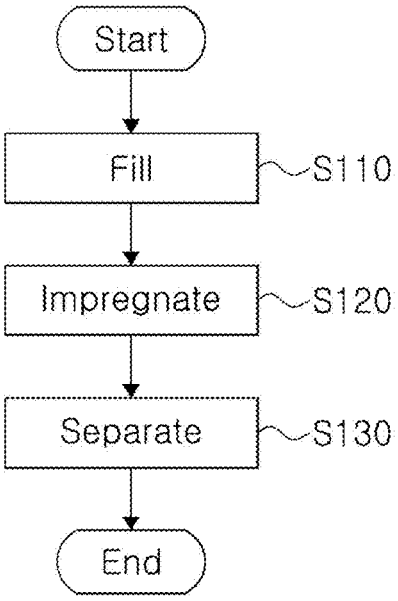
FIG. 4 is a flowchart illustrating a method of manufacturing a cosmetic impregnated foam according to the present disclosure.
Figure 5:
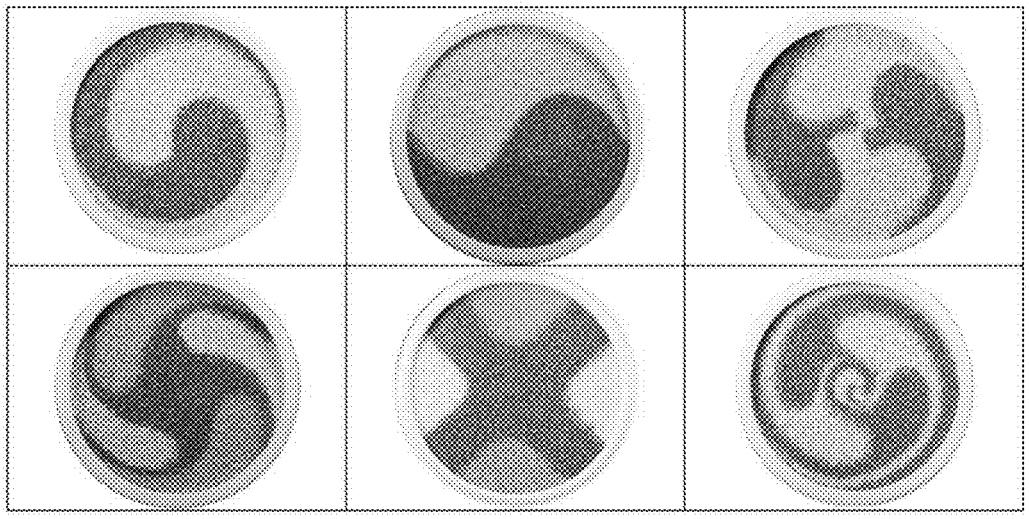
FIG. 5 is an exemplary diagram illustrating an impregnated foam manufactured by an apparatus and a method of manufacturing a cosmetic impregnated foam according to the present disclosure.

FIG. 2 is a diagram illustrating a cosmetic impregnated foam manufacturing apparatus according to the present disclosure, FIG. 3 is a diagram illustrating a pressing member of FIG. 2, FIG. 4 is a flowchart illustrating a method of manufacturing a cosmetic impregnated foam according to the present disclosure, and FIG. 5 is an exemplary diagram illustrating an impregnated foam manufactured by an apparatus and a method of manufacturing a cosmetic impregnated foam according to the present disclosure.

As illustrated in FIGS. 2 to 5, an apparatus A for manufacturing a cosmetic impregnated foam according to the present disclosure includes a fixing holder 100 that fixes a container 200, two or more multi nozzles 300 for filling the container 200 with liquid-state make-ups having different colors and viscosities, a pressing member 500 that presses an impregnated foam 400 to the container filled with the liquid-state make-ups, and a fabric 600 that is placed on the impregnated foam 400.

The fixing holder 100 is rotated and horizontally moved. The horizontal movement includes both of x-axial and y-axial movement herein. However, it may include only the x-axial movement.

Further, the fixing holder 100 is rotated and horizontally moved by a well-known driving element, that is, a motor, a hydraulic device, or a pneumatic device.

The container 200 has an open top and defines a space for keeping a liquid-state make-up. Further, the container 200 is received in a case such as a compact with an impregnated foam impregnated with a liquid-state make-up.

The multi nozzles 300 are two in the figures, but more multi nozzles may be used.

Further, the multi nozzles 300 are used for taking/discharging a liquid-state make-up inside/outside and the discharging amount is uniformly maintained.

Further, it is preferable that the viscosity difference of the two or more liquid-state make-ups filled in the multi nozzles 300 is within 3000 cps.

Figure 6:
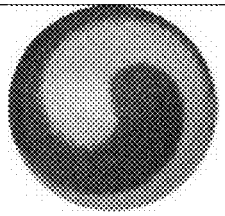
FIG. 6 is a table illustrating two liquid-state make-ups having different colors and different viscosities.
Figure 6:
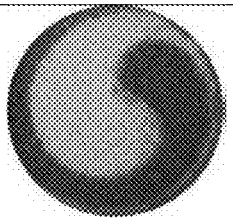

That is, as in FIG. 6, two or more liquid-state make-ups having different colors and viscosities have the be filled under the condition that the viscosity difference is 0 cps to 3000 cps in order to prevent the liquid-state make-ups having different colors from invading each other after filling or during impregnating.

On the other hand, when the viscosity difference is over the range, as in Table 1, liquid-state make-ups having different colors invade each other (the boundary breaks) in the process of impregnating the impregnated foam with the make-ups, so the commercial value decreases.

For reference, when the viscosity difference of liquid-state make-ups is less than 1000 cps, the liquid-state make-ups having different colors do not invade each other and the impregnation efficiency is the highest.

On the other hand, the filling ratio of an impregnated foam when two or more liquid-state make-ups having different colors are impregnated is as follows (A, B, and C).

A. Two or more colors are impregnated (first color: 1 to 99%, second color: 1 to 99%)

B. Three or more colors are impregnated (first color: 1 to 98%, second color: 1 to 98%, third color: 1 to 98%)

C. Four or more colors are impregnated (first color: 1 to 97%, second color: 1 to 97%, third color: 1 to 97%, fourth color 1 to 97%)

A pneumatic cylinder is applied to the pressing member 500, so the pressing member is vertically moved by air pressure.

Further, the pressing member 500 is moved to at a transfer speed until the impregnated foam 400 and the liquid-state make-up in the container 200 are brought in contact with each other, and when the impregnated foam 400 and the liquid-state make-up in the container 200 are brought in contact with each other, the pressing member 500 slowly presses the impregnated foam 400 at an impregnation speed lower than the transfer speed, and then when the impregnated foam 400 is impregnated with the liquid-state make-up in the container 200 and the impregnating is finished, the pressing member 500 is moved upward at the transfer speed and the fabric 600 is removed.

That is, during impregnation, the speed of the pressing member 500 is relatively adjusted, so the liquid-state make-ups having different colors are prevented from being mixed with each other.

Accordingly, liquid-state make-ups having different colors do not invade each other, so the commercial value is improved.

Further, the impregnated foam 400 gives sufficient time for absorbing the liquid-state make-up, so overflow of the liquid-state make-up is also prevented.

Further, air pressure of 1 to 2 $kg/m^2$ is applied to the pressing member 500 moving at the transfer speed, air pressure of 0.1 to 0.2 $kg/m^2$ is applied to the pressing member 500 moving at the impregnation speed, and the pressing member 500 stops for 2 to 4 seconds after pressing the impregnated foam 400 when the impregnated foam 400 is impregnated with a liquid-state make-up.

Since the pressing member 500 stops for 2 to 4 seconds after pressing the impregnated foam 400, the absorption ratio of liquid-state make-up of the impregnated foam 400 is improved.

According to the present disclosure, various colors and patterns are achieved by impregnating two or more liquid-state make-ups having different colors by the two or more multi nozzles 300 and the fixing holder 100 that is rotated and horizontally moved.

Further, by making the viscosity different of liquid-state make-ups having different colors within 3000 cps, the liquid-state make-ups having different colors are prevented from invading each other during impregnation.

Further, a pattern is prevented from being crushed by the fabric 600 on the impregnated foam 400 during pressing.

As a result, the commercial value is increased by the impregnated foam 400 with various colors and patterns.

A method of manufacturing a cosmetic impregnated foam according to the present disclosure is described.

First, the container 200 is filled with two or more liquid-state make-ups having different colors and viscosities and a pattern is formed (S110).

That is, when the two or more liquid-state make-ups having different colors and viscosities are discharged, the container 200 forms a pattern by being rotated and horizontally moved.

In this case, the liquid-state make-ups are discharged through the multi nozzles 300 and the container 200 is rotated and horizontally moved by the fixing holder 100.

Next, the impregnated foam 400 with the fabric 600 there on is put on the liquid-state make-ups in the container 200 and then impregnating is performed (S120).

That is, the impregnated foam 400 is moved at a transfer speed until the impregnated foam 400 and the liquid-state make-ups in the container are brought in contact with each other, and when the impregnated foam 400 and the liquid-state make-ups are brought in contact with each other, the impregnated foam 400 is impregnated with the liquid-state make-ups at an impregnation speed smaller than the transfer speed.

Further, after the impregnated foam 400 is impregnated in S120, it is stopped for 2 to 4 seconds.

Finally, the impregnated foam 400 and the fabric 600 are separated (S130).

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A method of manufacturing a cosmetic impregnated foam, comprising:

a) forming a pattern and filling a container with two or more liquid-state make-ups wherein the liquid-state make-ups have different colors and different viscosities;

b) putting an impregnated foam with a fabric thereon into the liquid-state make-ups in the container and performing impregnation; and c) separating the impregnated foam and the fabric.

2. The method of claim 1, wherein in the container is rotated and horizontally moved when the liquid-state make-ups are discharged into the container.

3. The method of claim 2, wherein the viscosity difference of the two or more liquid-state make-ups is less than 3000 cps.

4. The method of claim 1, wherein in the impregnated foam is moved at a transfer speed until the impregnated foam and the liquid-state make-ups in the container are brought in contact with each other, and when the impregnated foam and the liquid-state make-ups are brought in contact with each other, the impregnated foam is impregnated with the liquid-state make-ups at an impregnation speed less than the transfer speed.

5. The method of claim 4, wherein in the impregnated foam is stopped for about 2 to 4 seconds after being impregnated with the liquid-state make-ups.

* * * * *